US006149424A

United States Patent [19]

Marrecau et al.

[11] Patent Number: 6,149,424

[45] Date of Patent: Nov. 21, 2000

[54] UNDULATED BURNER MEMBRANE

[75] Inventors: Willy Marrecau, Rome; Ozzie Missoum, Kennesaw, both of Ga.

[73] Assignees: N. V. Bekaert S.A.; N. V. Acotech S.A., both of Zwevegem, Belgium

[21] Appl. No.: 09/383,186

[22] Filed: Aug. 26, 1999

[30] Foreign Application Priority Data

Aug. 28, 1998 [EP] European Pat. Off. ..... 98202879

[51] Int. Cl.[7] ..... F23D 14/14; F23D 14/16

[52] U.S. Cl. ..... 431/7; 431/326; 431/329; 431/328; 126/92 AC

[58] Field of Search ..... 431/7, 326, 328, 431/329, 170; 126/92 AC, 39 J, 92 R, 91 R

[56] References Cited

U.S. PATENT DOCUMENTS

| | | | |
|---|---|---|---|
| 1,731,053 | 10/1929 | Lowe . | |
| 3,122,197 | 2/1964 | Saponara et al. | 431/329 |
| 3,199,573 | 8/1965 | Flynn | 431/329 |
| 3,248,099 | 4/1966 | Bratko | 431/329 |
| 3,310,098 | 3/1967 | Hardison | 431/329 |
| 3,343,586 | 9/1967 | Berchtold et al. | 431/329 |
| 3,379,000 | 4/1968 | Webber et al. . | |
| 3,785,763 | 1/1974 | Bratko | 431/328 |
| 4,930,199 | 6/1990 | Yanagisawa | 29/4.51 |

FOREIGN PATENT DOCUMENTS

| | | | |
|---|---|---|---|
| 1160146 | 1/1984 | Canada | 431/329 |
| 0157432 | 12/1988 | European Pat. Off. . | |
| 1363504 | 10/1964 | France . | |
| 62-182510 | 8/1987 | Japan | 431/329 |
| 3-52642 | 3/1991 | Japan . | |
| 3-52642 | 4/1991 | Japan | 431/329 |
| WO 93/18342 | 9/1993 | WIPO . | |
| WO 95/27871 | 10/1995 | WIPO . | |
| WO 98/33013 | 7/1998 | WIPO . | |

OTHER PUBLICATIONS

Patent Abstracts of Japan, vol. 012, No. 343 (M–741), Sep. 14, 1988 (JP 63 101606).

Patent Abstracts of Japan, vol. 014, No. 056 (M–0929), Jan. 31, 1990 (JP 01 281312).

*Primary Examiner*—Carl D. Price

*Attorney, Agent, or Firm*—Foley & Lardner

[57] ABSTRACT

A membrane for radiant gas burners comprises a fabric (18) of metal fibers. The membrane has a surface which has a permanent undulation to such a degree that its surface area is at least five per cent greater than the surface area of a comparable flat membrane. In a preferable embodiment, the amplitude and the pitch of the undulation is such that, in operation, heat is radiated to and reflected from the flanks (24', 24") of the undulation. The result is an increased radiative output and radiative efficiency.

6 Claims, 1 Drawing Sheet

UNDULATED BURNER MEMBRANE

FIELD OF THE INVENTION

The present invention relates to a membrane for radiant gas burners and to a method of increasing the radiant power output of radiant gas burners. The membrane comprises a fabric of metal fibers.

BACKGROUND OF THE INVENTION

Such metal fiber membranes are well known in the art. They allow the radiant burners to heat up and cool down in a very fast way.

As a matter of example, WO-A-95/27871 discloses a metal fiber membrane for radiant gas burners where the membrane has been divided into a number of consecutive quadrangular porous zones in order to facilitate the thermal expansions when heating and thermal contractions when cooling down.

SUMMARY OF THE INVENTION

It is an object of the present invention to increase the radiative power output of a radiant burner.

It is also an object of the present invention to increase the radiative efficiency of a radiant burner.

It is yet another object of the present invention to provide simple means to increase the radiative power output and radiative efficiency of a radiant burner without using a reverberator.

According to a first aspect of the present invention there is provided a membrane for radiant gas burners. This membrane comprises a fabric of metal fibers. The membrane has a surface which has a permanent undulation to such a degree that its surface area is at least five per cent, and preferably at least ten per cent, greater than the surface area of a comparable flat membrane.

The terms "metal fibers" refer to fibers which can be manufactured by abrading the upper edge of a rolled metal foil, as described in U.S. Pat. No. 4,930,199, or by using the bundled drawing technique, as described, e.g., in the patent U.S. Pat. No. 3,379,000. The metal fibers have an equivalent diameter ranging between 2 $\mu$m and 150 $\mu$m, preferably ranging between 40 $\mu$m and 80 $\mu$m. The equivalent diameter of a fiber is the diameter of an imaginary round fiber having the same cross-section as that of the real fiber concerned. The metal fibers preferably have a composition which is resistant to high temperatures and to thermal shocks. For this purpose, they comprise minimum amounts of aluminum and chrome. In particular, FeCrAlY fibers as described in EP-B1-0 157 432, are very suitable. The metal fibers are further processed to form a contiguous porous fiber fabric, e.g. in the form of a non-woven web, a knitted, woven or wound fabric or mesh, or in the form of helicoidally and diagonally cross-wound metal fiber filaments.

The terms "permanent undulation" mean that there is a pronounced undulation irrespective of the fact that the burner is in operation or not. In other words, the permanent undulation is not a result of the thermal expansion or contraction.

The term "undulation" refers to every type of undulation or wave, irrespective of its form. It refers to both one-dimensional undulations, where the undulation is pronounced in one direction giving peak lines and not in a direction perpendicular thereto, and to two-dimensional undulations, where the undulation is pronounced in two different directions giving peak spots or peak points.

Radiant gas burners conveniently have their membrane fixed in a metal frame. The terms "comparable flat membrane" refer to a membrane which is fixed in a frame of equal dimensions and which has a flat surface. A relatively small bulging of the "flat" membrane is allowed under operating conditions. Despite this small bulging, it is still referred to as a flat membrane.

Radiant burners with a ceramic membrane having some indentations are known in the art, e.g. from U.S. Pat. No. 1,731,053. The function of these indentations, however, is to enhance the flame stability and to prevent a retrograde movement of the flame. A great distinction between radiant burners with a ceramic membrane and radiant burners with a membrane comprising a fabric of metal fibers, is that with a fabric of metal fibers the problem of flame stability has already been solved irrespective of the global form of the membrane. So even with a flat membrane no problems of flame instability will be present.

The undulation of the membrane according to the first aspect of the present invention has such an amplitude and pitch that, in operation, heat is radiated from a first flank to an adjacent flank and reflected from that flank again to the first flank and so on . . . so that the temperature of the membrane is substantially increased. The amount of radiation emitted by a body is proportional to the fourth degree of the temperature. So the temperature increase of the membrane increases significantly the radiation output of a burner having a membrane according to the present invention. As a consequence, the radiative power output of the gas burner is not only increased due to the increase in membrane surface but also due to the increase in membrane temperature.

According to an embodiment of the present invention, the burner membrane comprises a perforated metal screen which gives the undulation to the membrane and which supports the flexible fabric of metal fibers. Preferably this fabric is a non-sintered fabric and most preferably this fabric is a knitted structure. Such a knitted structure has the advantage that it heats up very rapidly. This fabric can be fixed, e.g. by means of welding spots to the screen.

According to a second aspect of the present invention, there is provided a method of increasing the radiant power output and efficiency of a radiant gas burner. The method comprises the following steps:

(a) providing a membrane with a fabric of metal fibers;

(b) undulating the membrane such that it obtains a surface area which is at least five per cent, preferably at least ten per cent, greater than the surface area of a comparable flat membrane.

BRIEF DESCRIPTION OF THE DRAWINGS

The invention will now be described into more detail with reference to the accompanying drawing wherein FIG. 1 schematically represents a radiant burner according to the first aspect of the present invention.

DESCRIPTION OF THE PREFERRED EMBODIMENTS OF THE INVENTION

Figure 1:
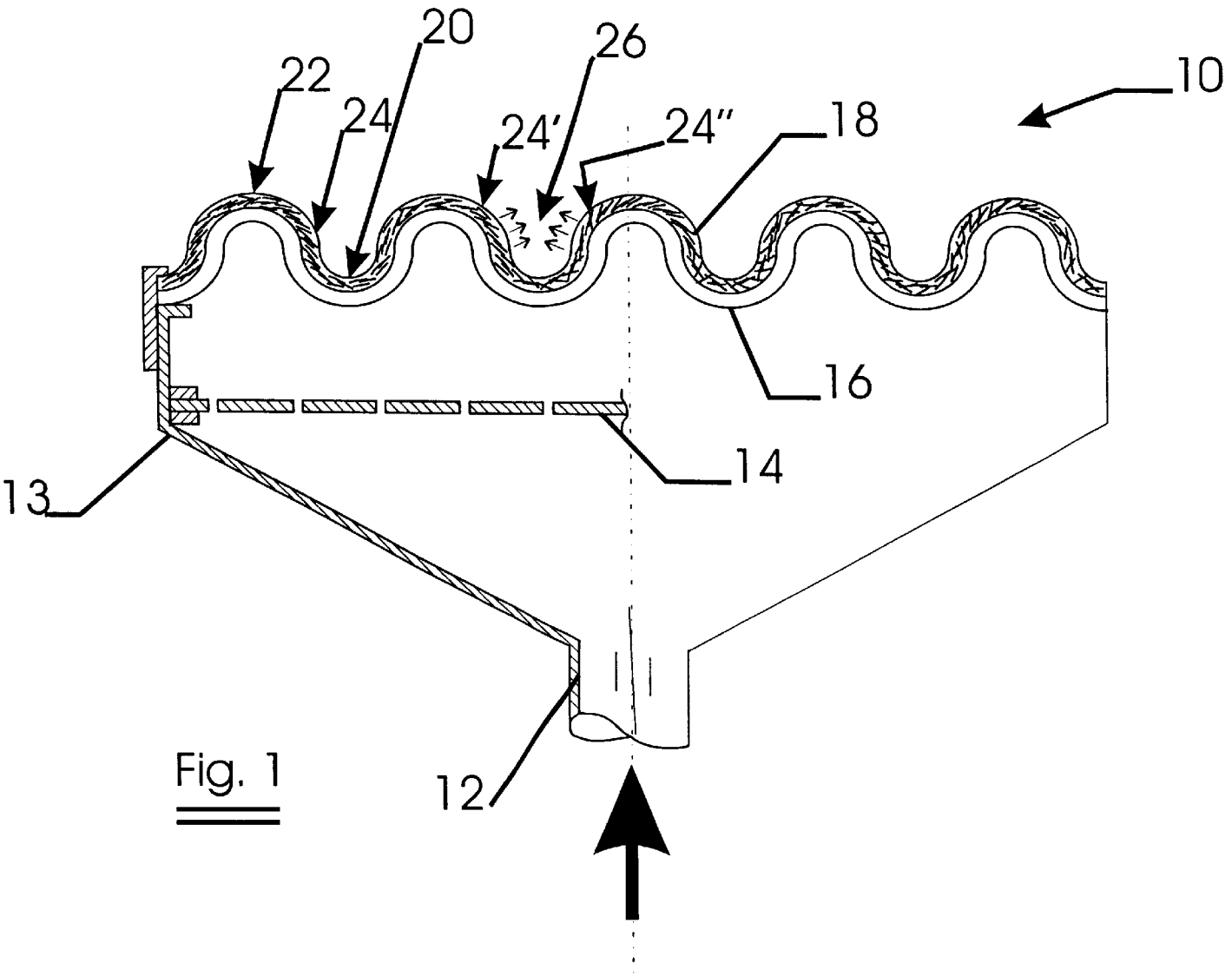

FIG. 1 schematically represents cross-section of a radiant gas burner 10 according to a first aspect of the present invention. An inlet duct 12 for the gas mixture is fixed to a housing 13, which is conveniently made of stainless steel or of ceramic. Distribution means 14 in the form of a perforated steel plate distribute the gas mixture as much as possible over the active surface of the burner. A preformed screen 16 with perforations (perforations not shown) in stainless steel gives the wavy or undulated shape to the membrane. A knitted structure 18 of FeCrAlY fibers is spot welded to the screen 16 and takes the undulated form of the screen 16. The undulation has the form of equally spaced valleys 20 and peaks 22, with flanks 24 between the valleys 20 and the peaks 22. As a matter of example, the heights of the peaks may range between 5 mm and 10 mm, the distance between the peaks may range between 25 mm and 40 mm.

As is indicated by arrows 26, heat is radiated from a left flank 24' to a right flank 24" and vice versa, and the heat which impinges upon a right flank 24" is reflected possibly again to the adjacent left flank 24'. Due to this to and fro reflection, the temperature of the membrane increases, which increases in its turn the radiative burner output.

Comparison

A burner with an undulated membrane according to the first aspect of the present invention has been compared with a comparable burner with a flat membrane. The frame of both the burner with the undulated membrane and the burner with the flat membrane was equal and had a width of 150 mm and a length of 200 mm. The burners were fired at heat inputs of 6740 Watt (23000 Btu/hr) and of 8499 Watt (29000 Btu/hr) at ten per cent excess air.

The installation used for the comparison comprised following parts:

- a TESTO-350 Series portable gas analyzer;
- a temperature measurement apparatus comprising a type K thermocouple and a continuous temperature recorder of the type YOKOGAWA LR 4110 Series;
- a black body flat plate (230 mm×300 mm) made of a highly oxidized steel ($\epsilon$=0.9) placed at exactly 6 inches (about 150 mm) parallel to the burner surface;
- a series of rotameters and pressure gages to control the fuel and air flow rates.

Propane and compressed atmospheric air were used for these experiments.

The type K thermocouple was placed at the center of the back side of the black body plate to measure the temperature at the center of the plate and the temperature which corresponds to the burner center. The thermocouple was covered by a mass of the steel, a 0.5 inch by 0.5 inch by 1 inch (=12.75 mm×12.75 mm×25.5 mm) bar welded at the back of the plate in order to minimize heat losses by convection to the atmosphere at that location as result of temperature and air stream variations in the room. Special care was taken as to achieve perfect conditions such as ten per cent excess air. The black body was insulated from the radiating heat by a 1 inch thick (=25.5 mm) ceramic plate until test conditions are achieved in the burner. Once the test conditions achieved, the insulating ceramic plate is pulled and the burner is instantly exposed to the radiating heat. The temperature recorder is then continuously recording temperature versus time. Once the temperature has reached a steady state, the flow of fuel propane is shut off but air is left on for cooling purposes of the burner. The time to reach steady state and the maximum or steady state temperature are extracted from the recorded data.

Burner temperatures are measured at two locations. The first one at 0.5 inch (=12.75 mm) from the burner surface center using the TESTO 350 Series portable gas analyzer. The second temperature was measured at the center of the burner surface using a MINOLTA-CYCLOPS 339 Series infrared thermometer.

The radiative output and the radiative efficiency are derived from the experimental data using following theoretical model:

$$q_{12} = \frac{\sigma(T_1^4 - T_2^4)}{(1-\varepsilon_1)/\varepsilon_1 A_1 + 1/A_1 F_{12} + (1-\varepsilon_2)/\varepsilon_2 A_2}$$

where

- $q_{12}$ is the net radiant energy exchanged between the burner surface and the black body plate surface;
- $\epsilon_1$ is the emissivity of the burner surface and assumed to be constant to 0.68;
- $\epsilon_2$ is the emissivity of the black body and equal to 0.90;
- $\sigma$ is the Stephan-Boltzman constant and equal to $5.67\times 10^{-8}$ $W/m^2k^4$
- $T_1$ and $T_2$ are the temperatures of the surface of the membrane resp. the black body;
- $F_{12}$ is the shape factor and is defined by the following equation:

$$F_{12} = \frac{((W_1+W_2)^2+4)^{1/2} - ((W_2-W_1)^2+4)^{1/2}}{2W_1}$$

where $W_1=L_1/L$ and $W_2=L_2/L$ with $L_1$ and $L_2$ being the lengths of the surfaces and L the distance between them.

The radiative burner efficiency was calculated based on the radiative energy exchanged between the membrane surface and the surface of the black body and the heat input with the assumption that the total burner efficiency is approximately equal to 0.8.

The radiative efficiency is defined as:

$$\eta = q_{12}/(0.8\times q_{input})$$

where $q_{input}$ is the heat input or fuel calorific value input.

The data are summarized in the table hereunder.

TABLE

| | Reference: flat burner | | Invention: undulated burner | |
|---|---|---|---|---|
| Membrane surface ($m^2$) | 0.0225 | | 0.0260 | |
| heat input (W) | 6740 | 8499 | 6740 | 8499 |
| Temperature at 12.75 mm from burner surface (° C.) | 871 | 921 | 902 | 942 |
| Burner surface temperature (° C.) | 960 | 985 | 1060 | 1147 |
| Final temperature of black body (° C.) | 275 | 290 | 298 | 342 |
| Time to reach final max. temperature (min) | 21 | 19 | 19 | 19 |
| radiative output (W) | 1675 | 1983 | 2544 | 3167 |
| radiative efficiency | 31.06 | 29.16 | 47.17 | 46.57 |

The wavy or undulating design of the burner membrane according to the invention offers more membrane surface area. In addition to the increase in surface area, the undulations enhance the reflection of radiation from the membrane surface onto itself which increased the membrane surface temperature and therefore more energy is radiated from the burner. These two synergetic effects result in more energy output and a higher burner effficiency. An increase of 30% or more in energy output and in efficiency was obtained with an increase in surface of only 15%.

What is claimed is:

1. A membrane for radiant gas burners comprising a fabric of metal fibers and a metal screen to be fixed in a frame, said membrane having a surface which has an undulation such that the surface area of said membrane is at least five per cent greater than a planar area bounded by said frame, said metal screen having an undulated surface for imparting said undulation to said membrane, said undulation having an amplitude and a pitch and having flanks, said amplitude and the pitch being such that, in operation, heat is radiated from one of said flanks to a neighboring flank.

2. A membrane according to claim 1, wherein said fabric of metal fibers is fixed to said metal screen.

3. A membrane according to claim 1, wherein said fabric is a knitted structure.

4. A method of increasing the radiant power output and efficiency of a radiant gas burner, said method comprising:

(a) providing a membrane comprising a fabric of metal fibers and a metal screen to be fixed in a frame;

(b) forming an undulation in said membrane, said undulation providing a surface to said membrane such that a surface area of said membrane is at least five per cent greater than a planar area bounded by said frame, said undulation having an amplitude and a pitch and having flanks, said amplitude and the pitch being such that, in operation, heat is radiated from one of said flanks to a neighboring flank.

5. A method as in claim 4, further comprising fixing said fabric of metal fibers to said metal screen.

6. A method as in claim 4, wherein said fabric of metal fibers is a knitted fabric.

* * * * *